US011684080B2

(12) United States Patent
Narasimhan et al.

(10) Patent No.: US 11,684,080 B2
(45) **Date of Patent: *Jun. 27, 2023**

(54) ELECTRONIC CIGARETTE COMPOSITIONS, DEVICES, AND RELATED METHODS

(71) Applicant: ZANOPRIMA LIFESCIENCES LIMITED, London (GB)

(72) Inventors: Ashok S. Narasimhan, London (GB); Raymond McCague, London (GB); Nicholas Hyde, London (GB); William Jackson, London (GB)

(73) Assignee: Zanoprima Lifesciences Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 17/279,003

(22) PCT Filed: Oct. 23, 2019

(86) PCT No.: PCT/EP2019/078957
§ 371 (c)(1),
(2) Date: Mar. 23, 2021

(87) PCT Pub. No.: WO2020/084024
PCT Pub. Date: Apr. 30, 2020

(65) Prior Publication Data

US 2021/0315261 A1 Oct. 14, 2021

(30) Foreign Application Priority Data

Oct. 24, 2018 (EP) ..... 18202355
May 22, 2019 (EP) ..... 19175946

(51) Int. Cl.
*A24B 15/167* (2020.01)
*A24F 40/10* (2020.01)
*A24F 40/42* (2020.01)
*A24B 15/28* (2006.01)

(52) U.S. Cl.
CPC ..... *A24B 15/167* (2016.11); *A24B 15/281* (2013.01); *A24B 15/287* (2013.01); *A24F 40/10* (2020.01); *A24F 40/42* (2020.01)

(58) Field of Classification Search
None
See application file for complete search history.

(56) References Cited

U.S. PATENT DOCUMENTS 9,004,073 B2 4/2015 Tucker et al.
2004/0013752 A1* 1/2004 Wolfson ..... A61K 9/0058 424/751
2014/0144429 A1* 5/2014 Wensley ..... A61M 15/06 128/200.14
2014/0190496 A1* 7/2014 Wensley ..... A24B 15/167 131/273
2014/0216237 A1* 8/2014 Butler ..... F41A 21/36 89/14.4
2014/0345635 A1* 11/2014 Rabinowitz ..... A24F 40/50 131/352
2017/0215476 A1* 8/2017 Dickens ..... A24F 40/44
2019/0261672 A1* 8/2019 Chaparro Leal ..... A24B 15/167

FOREIGN PATENT DOCUMENTS

| | | | | |
|---|---|---|---|---|
| CA | 3032555 | A1 | 4/2019 | |
| CN | 103371430 | A | 10/2013 | |
| CN | 103720030 | * | 4/2014 | |
| CN | 103989244 | * | 8/2014 | |
| CN | 103989245 | * | 8/2014 | |
| GB | 2583657 | A | 11/2020 | |
| JP | 2017-530705 | A | 10/2017 | |
| JP | 2021-500046 | | 1/2021 | |
| KR | 101208473 | B1 * | 12/2012 | |
| KR | 101208473 | B1 | 12/2012 | |
| KR | 20160119459 | A | 4/2015 | |
| KR | 20160097425 | A | 8/2016 | |
| KR | 2017538448 | A * | 12/2017 | |
| WO | WO-2016050244 | A1 * | 4/2016 | ..... A24F 40/30 |
| WO | 2017/097840 | A1 | 6/2017 | |

OTHER PUBLICATIONS

Nicotine NPL (https://www.sigmaaldrich.com/US/en/sds/SIGMA/N3876?sdslanguage=EN) (Year: 2021).*
CO2 NPL (https://www.sigmaaldrich.com/US/en/sds/aldrich/295108) (Year: 2021).*
Water NPL (https://www.sigmaaldrich.com/US/en/sds/sigald/38796) (Year: 2021).*
Glycerol NPL (https://www.sigmaaldrich.com/US/en/sds/sial/g9012) (Year: 2021).*
KR101208473B1 translation (Year: 2022).*
JP 2017538448 A translation (Year: 2022).*
Notification of Grant for Patent App. No. GB2010902.1, Patent No. GB2583657 from the United Kingdom Intellectual Property Office dated Feb. 23, 2021, 2 pages.
International Search Report and Written Opinion dated Jan. 31, 2020 in International Patent Application No. PCT/EP2019/078957, filed Oct. 23, 2019, 15 pages.
Notice of Reasons for Rejection for JP Appln. No. 2021-523242 dated Nov. 16, 2021, 4 pages.
Peace et al., "Concentration of Nicotine and Glycols in 27 Electronic Cigarette Formulations", *Journal of Analytical Toxicology* 2016;40;403-407 doi: 10.1093/jat/bkw037.
Examination Report for India Appln No. 202117018025 dated Jan. 2, 2023, 6 pages.

* cited by examiner

*Primary Examiner* — Xiao S Zhao
*Assistant Examiner* — Guy F Mongelli
(74) *Attorney, Agent, or Firm* — Kilpatrick Townsend & Stockton LLP

(57) ABSTRACT

Disclosed herein is an inhalable composition, suitable for use in an electronic cigarette device, comprising at least 1 g/L of nicotine and carbon dioxide dissolved or dispersed in a solvent.

9 Claims, No Drawings

ELECTRONIC CIGARETTE COMPOSITIONS, DEVICES, AND RELATED METHODS

FIELD OF THE INVENTION

The present invention relates to inhalable compositions for use in an electronic cigarette device, and their methods of manufacture.

BACKGROUND OF THE INVENTION

Nicotine (3-[1-methylpyrrolidin-2-yl]pyridine) may be obtained from the leaves of *Nicotiana*, i.e. the tobacco plant, or manufactured by chemical synthesis. Across the tobacco industry, there remains a demand for traditional tobacco products (e.g. traditional cigarettes, cigars, or pipe fillings) which is likely due to the addictive nature of nicotine. However, there is an increasing demand for replacement tobacco products due to growing concern around the detrimental impact of traditional tobacco products on consumer health. Replacement tobacco products may be provided as a substitute for traditional tobacco products that would otherwise result in harmful carcinogenic effects; e.g. due to the presence of pyridine alkaloids, polycyclic aromatics, phenols and N-nitrosamines. Such replacement products may be used recreationally, but may also be used in the pharmaceutical field specifically to treat nicotine dependence; within the pharmaceutical field, there is also interest in the possible therapeutic applications of nicotine. While a number of replacement tobacco products exist, there is particular demand for electronic cigarette devices. Typically, electronic cigarette devices contain a solution or dispersion of nicotine that, upon heating by a heating element, is vaporised and inhaled by the user.

For both electronic cigarette devices and traditional tobacco products alike, consumers value a pleasant user experience. This can be challenging to achieve, as nicotine can cause both pleasant and unpleasant sensations in the airways e.g. in the mouth, throat and lungs. For example, nicotine can result in a pleasant sensation in the throat, sometimes referred to as a "throat hit", which is thought to be due to the nicotine causing muscle contractions in the throat. There is also the pleasant sensation due to the physiological effects due to the nicotine, which can include mild dizziness. However, nicotine can also result in unpleasant sensations in the airways. In particular, some users report an unpleasant rough or astringent sensation in the throat. For a pleasant user experience, the nicotine should be formulated such that its pleasant effects are maintained but its unpleasant effects are minimised.

In the electronic cigarette field is Korean Patent KR 10-1208473, which provides compositions containing a maximum of 20 mg/25 ml of nicotine (which equates to a maximum 0.8 grams per litre or 0.08% wt/vol). Such compositions, with their notably low nicotine content, seek to encourage smoking cessation. KR 10-1208473 reports the presence of carbon dioxide dissolved within the low nicotine compositions to assist with the atomisation of the solution. However, in this document the solubility of carbon dioxide in the composition is stated to be low, such that KR 10-1208473 reports the necessity of a "food grade alcohol", in particular ethanol, and certain quantities of water, as a means to increase the solubility of carbon dioxide. The production of the nicotine-containing formulations in KR 10-1208473 involves the production of a solution of carbon dioxide dissolved/dispersed in the associated solvents, and only subsequently adding the nicotine to the solution, i.e., after it has been charged with carbon dioxide.

Also in the art are the traditional tobacco products disclosed in U.S. Pat. Nos. 3,878,850 and 4,830,028 that seek to avoid the harsh, irritant, or "choky" sensations caused by nicotine. In the electronic cigarette field is WO 2014/182736, which concerns electronic cigarette formulations that seek to provide user satisfaction to an individual using a nicotine salt formulation.

However, the challenge of providing a pleasant user experience for electronic cigarettes remains. In addition to the challenge of providing a pleasant user experience, electronic cigarettes present their own challenges for nicotine formulation over and above those faced by traditional tobacco products. For example, as well as ensuring a pleasant user experience, there are other desirable qualities for the liquid nicotine formulation such as a pleasing appearance to consumers, good shelf life, low adverse health effects, and good compatibility with the electronic cigarette device itself.

SUMMARY OF THE INVENTION

The present invention is directed towards inhalable compositions with enough nicotine to provide a sufficiently satisfying user experience, namely those with at least 1 g/L of nicotine. The unpleasant rough or astringent sensations caused by nicotine on the airways when vapour is inhaled from an electronic cigarette may be explained by its alkalinity. The present invention is in part based on the realisation that, upon inhalation, the ingredients present in the inhalable composition dissolve in the water present on and in the tissues of the airways, allowing the carbon dioxide to reversibly form carbonic acid. This neutralises the alkalinity of the nicotine, thereby reducing the astringent sensation.

In the prior art (such as Korean Patent KR 10-1208473) achieving adequate solubility of carbon dioxide in the inhalable composition is disclosed as requiring the presence of certain solvents, namely water and ethanol. Even with these solvents present, the solubility of carbon dioxide is disclosed as being at most 18.1 mg/25 ml; i.e. 0.724 g/L (approximately 0.07 wt %), which is sub-optimum for electronic cigarettes with higher levels of nicotine.

The present invention provides new inhalable compositions as a surprising new means of achieving a pleasant user experience, enabled by the finding of a more effective manner of incorporating carbon dioxide into the inhalable composition.

In a first aspect of the invention, there is an inhalable composition, suitable for use in an electronic cigarette device, comprising at least 1 g/L of nicotine and at least 2 g/L of carbon dioxide dissolved or dispersed in a solvent, wherein the molar ratio of carbon dioxide to nicotine is at least 0.1:1.

The first aspect of the present invention provides an inhalable composition with an increased carbon dioxide content in comparison to the prior art, allowing for improved neutralisation of nicotine. The surprisingly increased carbon dioxide content is enabled by the finding that the solubility of carbon dioxide is improved when the carbon dioxide is added to a composition already containing both nicotine and solvent. This results in increased solubility of carbon dioxide compared to the compositions enabled by the prior art, such as KR 10-1208473, where the carbon dioxide is added to the solvents prior to the addition of nicotine. It is thought that it is the presence of nicotine in the composition at the time of dissolution of carbon dioxide that influences the solubility. This increased solubility of carbon dioxide in solvents which already contain nicotine is particularly surprising given that solubility of carbon dioxide in nicotine alone is low. This increased solubility of carbon dioxide is provided without having to resort to solvent systems that might otherwise impart undesirable qualities to the composition, in particular those containing ethanol, which is a flammable solvent, and so poses a potential explosion hazard upon vaporisation.

The compositions disclosed herein are compatible with a variety of different solvent systems, and may for example include water at various levels. Nevertheless, although the compositions are compatible with various water contents, they do not require a high water content to enable dissolution of carbon dioxide. Accordingly, in a second aspect of the invention, there is an inhalable composition, suitable for use in an electronic cigarette device, comprising at least 1 g/L of nicotine and at least 0.027 g/L of carbon dioxide dissolved or dispersed in a solvent, wherein the molar ratio of carbon dioxide to nicotine is at least 0.025:1, wherein the solvent comprises at most 5% by volume water in relation to the total volume of solvent.

The second aspect of the invention provides an inhalable composition containing carbon dioxide, and specifically excludes scenarios where the solvent comprises more than 5% by volume water in relation to the total volume of solvent. This is a surprising contrast to the compositions enabled by the prior art, such as those in KR 10-1208473, which teach that the dissolution of carbon dioxide requires significantly higher quantities of water. Surprisingly effective dissolution of carbon dioxide at such low (or zero) water contents is enabled by the finding that the solubility of carbon dioxide in the composition is improved when the carbon dioxide is added to a composition already containing both nicotine and solvent, as set out in relation to the first aspect. The second aspect provides the further improvement that, by virtue of its lower water content, the composition displays reduced discoloration on storage, resulting in a composition with a more pleasing appearance to consumers. Such coloration is indicative of decomposition, indicating that the compositions disclosed herein possess improved stability and a longer shelf life. There is then the additional advantage that for the inhalable compositions disclosed herein, there is no need to resort to methods of obscuring colouration e.g. by using packaging.

The inhalable compositions according to the first and the second aspect have good smoothness due to the inclusion of carbon dioxide, which leads to a reduced astringent sensation, whilst maintaining the sensation of a pleasant "throat hit". The improved user experience is achieved without having to resort to undesirable solvents (such as ethanol) or excessive flavourings to mask the unpleasant astringent sensations. The lack of reliance on excessive flavourings is beneficial, as excessive flavourings can increase the risk of adverse long-term health effects in users. The inhalable compositions also display good compatibility with electronic cigarette devices, which is thought to be due to the properties of the carbon dioxide. It is thought that the properties of carbon dioxide are such that the inhalable composition has improved compatibility with electronic cigarette devices compared to inhalable solutions containing alternative additives included with the view of overcoming astringency. For example, carbon dioxide does not leave behind any unfavourable residue in the electronic cigarette device that might otherwise build up over time and potentially lead to a failure of the device. Further, compared with alternative means to mask unpleasant astringency and so provide a more pleasant user experience, the use of carbon dioxide offers a considerably reduced risk of undesirable interactions between other ingredients present in the inhalable composition e.g. the solvent, which might otherwise lead to uncharacterised compounds with unknown properties. Consequently the inhalable compositions according to the first and the second aspect are thought to be safer in terms of the impact on user health.

In a third aspect, there is a cartridge suitable for use with an electronic cigarette device, said cartridge containing the inhalable composition according to the first or second aspect.

In a fourth aspect, there is an electronic cigarette device comprising the cartridge the third aspect.

In a fifth aspect, there is the use of the inhalable composition according to the first aspect or the second aspect in an electronic cigarette device.

In a sixth aspect, there is a method of making the inhalable composition according to the first aspect or the second aspect.

In a seventh aspect, there is a concentrate suitable for forming an inhalable composition for use in an electronic cigarette device, comprising at least 60 g/L of nicotine and carbon dioxide dissolved or dispersed in a solvent, wherein the molar ratio of carbon dioxide to nicotine is at least 0.1:1. Concentrates are useful for storage and transport purposes, to provide a feedstock to produce electronic cigarette solutions in a range of concentrations or with different flavourings for the market, or to provide a strong solution for an intense user experience.

DETAILED DESCRIPTION

As used herein, the term "inhalable composition" refers to a composition that is suitable for inhalation by a user. The inhalable compositions disclosed herein are suitable for use in an electronic cigarette device, meaning that they can be vaporised by the heating element of such devices thereby allowing inhalation by a user. Unless otherwise specified, the phrase "the inhalable composition" or "the inhalable compositions" refers to the inhalable composition of both the first and second aspects of the invention.

As used herein, the term "nicotine" refers to nicotine obtained from the tobacco plant or from chemical synthesis, and can refer to (R)-nicotine, (S)-nicotine or combinations thereof. Whilst the improvement in user experience applies to all forms of nicotine, the nicotine is preferably predominantly (S)-nicotine i.e. (S)-nicotine with an enantiomeric excess of over 50%. More preferably the nicotine is (S)-nicotine with an enantiomeric excess of at least 60%, at least 70%, at least 80%, at least 90%, or at least 95%. It is acknowledged that (S)-nicotine (i.e. [(S)-3-(1-methylpyrrolidin-2-yl)pyridine]) is significantly more active than (R)-nicotine.

It was found that the improvement in user experience was more pronounced when nicotine extracted from tobacco was used rather than nicotine made by chemical synthesis. It is thought that this is due to the carbon dioxide being particularly effective in neutralising not only the nicotine itself, but also the nicotine impurities present in the tobacco, thereby avoiding the otherwise unpleasant sensations that these impurities can cause. The amount of such impurities in tobacco is inconsistent in that their amount can vary according to geographic source, time of harvest of the tobacco etc. Therefore the inclusion of carbon dioxide to neutralise the effect of such impurities provides a more consistent product in terms of the user experience. Nevertheless, improvement in the consistency of user experience is also provided for nicotine made by chemical synthesis. Synthetic nicotine may also be contaminated with small amounts of process related impurities which could vary in content and thereby alter the user experience, and so inclusion of carbon dioxide provides additional benefit of assuring against the possibility of an altered user experience arising from the presence of such impurities.

The inhalable compositions disclosed herein can, by way of their improved user experience, more effectively assist a user's transition away from traditional cigarette smoking. In transitioning from tobacco smoking to electronic cigarettes, users find pleasant any sensations with the vaping that they associate with their accustomed experience from their tobacco smoking. Tobacco smoke contains large quantities of carbon dioxide resulting from the combustion of the cigarette material that will play a significant part in the sensations the user gets from tobacco smoking. Without wishing to be bound by theory, it is thought that by introducing carbon dioxide into the formulation of the liquid for the electronic device, that carbon dioxide will in part give a familiar sensation that is perceived as contributing to the pleasant experience. Therefore by better mimicking the composition of tobacco smoke, this invention can more effectively assist their transition away from cigarette smoking.

The inhalable composition comprises at least 1 g/L of nicotine, preferably at least 3 g/L of nicotine, more preferably at least 5 g/L of nicotine. The inhalable composition may comprise at most 60 g/L of nicotine, preferably at most 50 g/L or at most 40 g/L of nicotine. Such amounts of nicotine refer to the amount of nicotine added to the inhalable composition.

According to the first aspect of the invention, the inhalable composition comprises at least 2 g/L of carbon dioxide. According to the second aspect of the invention, the inhalable composition comprises at least 0.027 g/L of carbon dioxide, preferably at least 1 g/L more preferably at least 2 g/L.

More preferably, according to either aspect of the invention, the inhalable composition comprises at least 3 g/L, more preferably at least 5 g/L of carbon dioxide. The inhalable composition may comprise at most 40 g/L of carbon dioxide, preferably at most 34 g/L of carbon dioxide, more preferably at most 20 g/L or at most 10 g/L of carbon dioxide. Such amounts of carbon dioxide refer to the amount of carbon dioxide initially incorporated into the inhalable composition.

At such amounts disclosed herein, the carbon dioxide does not itself lead to any toxic or irritant effects in the airways. After the carbon dioxide is initially incorporated into the inhalable composition, a proportion of it may form carbonic acid derivatives and salts therefrom in the composition prior to inhalation, depending on the solvent conditions. In this scenario the skilled person would readily be able to calculate the amount of carbon dioxide that was initially incorporated into the inhalable composition.

In the inhalable composition according to the first aspect, the molar ratio of carbon dioxide to nicotine is at least 0.1:1. In the inhalable composition according to the second aspect, the molar ratio of carbon dioxide to nicotine is at least 0.025:1, preferably at least 0.1:1. This ratio is calculated on the basis of the nicotine and carbon dioxide added to the composition. By taking account of the mass in g of carbon dioxide and nicotine that have been added to the composition, and the relative molecular masses of carbon dioxide and nicotine, the skilled person is able to deduce the molar ratio between these two components.

More preferably, according to either aspect of the invention, the molar ratio of carbon dioxide to nicotine in the inhalable composition is at least 0.25:1, more preferably at least 0.4:1, more preferably at least 0.5:1. The molar ratio of carbon dioxide to nicotine can be at least 0.75:1, at least 1:1 or at least 7.5:1. The molar ratio of carbon dioxide to nicotine can be at most 10:1, at most 7.5:1, at most 5:1, or at most 2.5:1.

Within the ranges of nicotine disclosed herein, there are particularly preferred corresponding amounts of carbon dioxide, depending on whether the composition contains comparatively higher or lower amounts of nicotine. These ratios can therefore be tailored accordingly, depending on whether the composition is subject to a higher or a lower content of nicotine For example, when the inhalable composition comprises 1-30 g/L, or 1-25 g/L of nicotine, the molar ratio of carbon dioxide to nicotine is preferably in the range of 0.75:1 to 10:1, more preferably 2:1 to 9:1. Meanwhile, when the inhalable composition comprises 30-60 g/L, or 30-50 g/L of nicotine, the molar ratio of carbon dioxide to nicotine is preferably in the range of 0.1:1 to 2:1, more preferably 1.5:1 to 2:1.

The inhalable composition comprises a solvent preferably an organic solvent. Preferably, the solvent comprises, or is selected from the group consisting of, glycerol (propane-1,2,3-triol), propylene glycol (propane-1,2-diol), water, or mixtures thereof. As can be seen from the examples, a variety of different solvent systems may be used in the inhalable composition whilst still achieving the desired dissolution of carbon dioxide. The exact nature of the solvent system can therefore be tailored accordingly depending on formulation preferences.

The solvent may comprise propylene glycol. For example, propylene glycol can be present in the inhalable composition in an amount of 0-25% by weight, based on the total weight of the inhalable composition. The presence of propylene glycol provides some formulation benefits, mainly by encouraging the formation of a plume of vapour from the device when used by the user. However for the inhalable compositions disclosed herein there is a preference for little to no propylene glycol on account of the potential impact on user health. For example, some users report that the presence of propylene glycol in inhalable compositions results in headaches. It is also thought that the presence of propylene glycol in inhalable compositions can result in various irritant effects. Further, the risks of long-term inhalation of formulations containing propylene glycol are unknown. Accordingly, propylene glycol is preferably present in an amount of no more than 15%, preferably no more than 10%, more preferably no more than 5% by weight based on the total weight of the inhalable composition. In some embodiments, the inhalable compositions are free from propylene glycol.

Preferably, the solvent comprises glycerol. Glycerol is considered to bring with it fewer long-term health risks compared with propylene glycol, thereby resulting in a composition thought to be safer due to a lower risk of negative impact in user health. It was previously thought that carbon dioxide would have a lower solubility in glycerol compared to propylene glycol. However surprisingly, the inhalable compositions disclosed herein achieved surprisingly high solubility of carbon dioxide irrespective of the solvent system, enabled by the finding that the solubility of carbon dioxide is improved when the carbon dioxide is added to a composition already containing both nicotine and solvent. Generally, glycerol can be present in the inhalable composition in an amount of 40-95% by weight, based on the total weight of the inhalable composition. Glycerol can be present in an amount of at least 50%, preferably at least 60%, more preferably at least 70% by weight based on the total weight of the inhalable composition.

When the solvent comprises glycerol and propylene glycol, the proportion of glycerol to propylene glycol present in the solvent can be in the range of 95:5 to 5:95 by volume, preferably 80:20 to 20:80 by volume or 70:30 to 30:70 by volume. On account of the preference for an increased proportion of glycerol vs propylene glycol, as described above, the proportion of glycerol to propylene glycol present in the solvent is preferably at least 70:30, more preferably least 80:20, even more preferably at least 90:10 by volume.

The solvent may comprise water. The inhalable compositions are compatible with a variety of concentrations of water. This has the added benefit that the water content can be tailored for a given composition to adjust the viscosity to a desirable level. Although the inhalable compositions are compatible with a variety of concentrations of water, they do not require the presence of water in order to achieve sufficient dissolution of carbon dioxide. Indeed, the second aspect of the invention specifically excludes scenarios where water is present above a certain amount, which is in surprising contrast to the prior art. Specifically, according to the second aspect of the invention, the water, when present, is present in an amount of up to 5% by volume in relation to the total volume of solvent. However, more generally according to the first aspect of the invention, the water can be present in an amount of no more than 20%, preferably no more than 15%, more preferably no more than 10% by weight based on the total weight of the inhalable composition. The first aspect of the invention is also compatible with no more than 5% water by weight based on the total weight of the inhalable composition; sufficient dissolution of carbon dioxide is still achieved at such reduced water levels, which then provide the additional advantage of minimising leakage when the inhalable composition is included in pods for delivery to the user.

Although the presence of water is not required for adequate carbon dioxide dissolution, a small amount of water may be beneficial, as it is thought that, after inhalation, the vaporised water provides additional wetting to the surface of the tissues in the user's airways, resulting in a greater medium within which the carbon dioxide can dissolve, thereby increasing the amount of carbonic acid available to counteract the alkalinity of the nicotine and so counteract the unpleasant astringent sensation. Furthermore, the presence of a small amount of water generally brings the average volatility of the solvent system closer to that of nicotine, which allows a more constant level of nicotine to be delivered over the course of a single inhalation. Therefore, water is preferably present in either the first aspect or the second aspect of the invention in an amount of at least 1% by weight, based on the total weight of the inhalable composition. As will be appreciated, when the solvent comprises water in the amounts disclosed herein, the solvent may further comprise one or more of glycerol and propylene glycol, preferably in the proportions disclosed herein.

Preferably, the inhalable composition comprises less than 10 g/L of flammable solvent such as ethanol. More preferably, the inhalable composition is free from flammable solvent such as ethanol. The presence of a volatile flammable solvent, in particular ethanol, is undesirable as it has the potential to reach a high concentration in the initial vapour in the device, and cause a potential explosion hazard.

The composition may include one or more optional ingredients such as one or more flavouring compounds or one or more additives.

The improved user experience associated with the compositions disclosed herein is such that excessive flavours need not be included in order to mask the unpleasant astringent effects. Nevertheless, the compositions disclosed herein are compatible with the addition of one or more flavouring compounds, which may be included in up to 15% by volume, or up to 10% by volume, based on the total volume of the composition.

The inhalable composition may be included in a cartridge that is suitable for insertion into an electronic cigarette device. Generally, the cartridge is provided as a sealed cartridge containing the inhalable composition prior to insertion into the electronic cigarette device.

As the skilled person will appreciate, the volume of the inhalable solution will vary depending on the specific electronic cigarette device in question and the size of the associated cartridge. Typically, the volume of inhalable solution can vary between 0.2 ml to 10 ml, or between 0.25 ml to 7 ml.

The method of making the inhalable composition disclosed herein comprises the steps of forming a dispersion or solution of nicotine in a solvent inside a sealable vessel; and introducing carbon dioxide to the vessel such that the pressure inside the vessel is in the range of 1 to 15 atmospheres, preferably 2 to 10 atmospheres, more preferably 2-5 atmospheres, most preferably 4-5 atmospheres as measured at 20° C., such that the carbon dioxide dissolves or disperses into the dispersion or solution of nicotine.

Also disclosed herein is a concentrate suitable for forming an inhalable composition for use in an electronic cigarette device comprising carbon dioxide and at least 60 g/L of nicotine dissolved or dispersed in a solvent, wherein the molar ratio of carbon dioxide to nicotine is at least 0.1:1. The concentrate may comprise at least 80 g/L or at least 100 g/L. Preferably, the concentrate comprises at most 500 g/L of nicotine, more preferably at most 300 g/L of nicotine. The dissolution of carbon dioxide in such concentrates may be achieved by charging a vessel to an increased pressure of carbon dioxide in order to compensate for the compositions particularly concentrated nature. As mentioned previously, the most preferable molar ratio of carbon dioxide to nicotine can be tailored depending on the nicotine content. For the particularly high nicotine contents of the concentrate, the molar ratio of carbon dioxide to nicotine is preferably in the range of 0.1:1 to 2:1, more preferably 0.1:1 to 1:1.

The following non-limiting examples illustrate the invention.

Example 1 (with Synthetic Nicotine)

A solution of synthetic nicotine was made at a concentration of 2.5% w/w (i.e. 2.5 g per 100 g) in an 80:20 mixture of glycerol and propylene glycol. The solution was divided in half, and to one half was added 1.0% water (w/w). Portions of each of these solutions (20 ml) were introduced to screw-capped plastic bottles having a capacity of 520 ml and to each was added 4-5 g solid carbon dioxide (dry ice) sufficient to achieve a pressure of 4-5 bar. The capped bottles were allowed to equilibrate so pressure built up in them. Control mixtures likewise were created as above except that no carbon dioxide was added. This resulted in the formation of four samples:

Sample 1: 2.5% (w/w) synthetic nicotine

Sample 2: 2.5% (w/w) synthetic nicotine with carbon dioxide

Sample 3: 2.5% (w/w) synthetic nicotine with 1% (w/w) water

Sample 4: 2.5% (w/w) synthetic nicotine with carbon dioxide and 1% (w/w) water

As stated the amount of nicotine in each Sample was 2.5% (w/w), which given the density of the solvent system of each sample is approximately 3.0 g per 100 ml or 3.0% w/v.

The pH of each sample was measured by taking a portion of each sample, diluting the portion with an equal volume of water and measuring the pH. A control solution (no CO2) showed a pH of 9.3. A solution from a mixture with carbon dioxide introduced showed a pH of 6.9-7.0.

Samples 1-4 were tested for inhalation experience in a vaporisation device. The vaporisation devices used in the tests had rebuildable dripping atomisers (RDA), specifically a "geek vape" model Tsumani 24 RDA, and consisted of two dripping atomisers filled with a 8-turn coil of 0.4 mm Kanthal wire having a resistance of approximately 1.1 ohm. Vaporisation was achieved using a power of 24 Watts. The same Nakamichi (Japanese) Cotton was used to provide the wicks for each RDA. The wick was changed and the atomizer cleaned between each eLiquid tested. The mods (which provide the electrical power to the atomizer) were one or the other of Vaporshark rDNA units or Aspire NX75 units. These two mods are sufficiently close in design and performance to make comparison meaningful. These mods have both temperature and power control. The mods were used in power mode, each mod set to deliver 24 watts to the atomizer. At this power level and with this coil, the temperature of the coil in use is likely to around 200° C., well below the boiling point of Glycerine, the major component of the e-liquid. For the initial tests, only the two Vaporshark mods were available and so initial tests were run using paired comparison. For the later tests, five liquids could be compared in one test run. The more extended tests allowed the use of a constant "standard" as noted below against which other results could be benchmarked as needed. The use of the standard allowed the standard and two pairs of e-liquids to be tested in each batch of 5 tests. The results of the initial tests using 2 mods were confirmed in using the extended 5 mod set up.

The user experienced that mixtures without CO2 present gave a harsh feel astringent sensation in the mouth and throat when inhaled. The mixtures with the CO2 gave a smoother sensation in the mouth and throat. The user tabulated the results in Table 1:

TABLE 1

| Sample | Sample description | Summary of vaping experience |
|---|---|---|
| 1 | 2.5% (w/w) synthetic nicotine | This sample was as good as the best of the tobacco-extracted 2.5% nicotine samples i.e. Example 2; sample 13 (the smoothness and throat hit were similar). This is a very strong e-liquid to vape, only possible to vape small amounts with the atomizer. |
| 2 | 2.5% (w/w) synthetic nicotine with carbon dioxide | Smoother than sample 1. |
| 3 | 2.5% (w/w) synthetic nicotine with 1% (w/w) water | As good as sample 2, better than 1 by a similar margin. |
| 4 | 2.5% (w/w) synthetic nicotine with carbon dioxide and 1% (w/w) water | As smooth as 2 and 3 but with a stronger throat hit. |

Example 2 (with Tobacco Nicotine)

Solutions were prepared as for Example 1 except using nicotine that had been extracted from tobacco and with solutions at both 1.0% w/w (i.e. 1 g per 100 g) and 2.5% nicotine w/w (i.e. 2.5 g per 100 g). The details of the vaporisation units are as described in Example 1. The results are shown in Table 2.

As stated the amount of nicotine in each Sample was either 2.5% (w/w), which given the density of the solvent system of each sample is approximately 3.0 g per 100 ml or 3.0% w/v; or, it was 1% (w/w), which given the density of the solvent system of each sample is approximately 1.2% w/v.

TABLE 2

| Sample | Sample description | Summary of vaping experience |
|---|---|---|
| 5 | 1% (w/w) nicotine | Vapour tasted quite harsh in the mouth and there was limited throat hit. |
| 6 | 1% (w/w) nicotine with carbon dioxide | Improvement from sample 5; it is smoother than 5, has a stronger 'nicotine' effect with better throat hit. |
| 7 | 1% (w/w) nicotine with carbon dioxide and 1% water (w/w) | A better experience than both samples 5 and 6, although the improvement over sample 6 is small. The nicotine effect was noticeably stronger than sample 5. The vape was less harsh than 6 and with more of a throat hit. A vaper could probably get used to either sample 6 or 7, with a small preference for 7. |
| 8 | 1% (w/w) nicotine with 1% water (w/w) | Adding water alone has made this smoother than the control sample 5 so that the effect is similar to adding carbon dioxide from a smoothness perspective making this sample similar to sample 6 but not as good as sample 7 (carbon dioxide and water); sample 7 has a better throat hit. |
| 9 | 2.5% (w/w) nicotine | Very harsh taste in mouth, mouth hit from harshness overpowers any throat hit. |
| 10 | 2.5% (w/w) nicotine with 1% water (w/w) | Very harsh, pretty close to 9, strong hit in mouth |
| 11 | 2.5% (w/w) nicotine with 2% water (w/w) | Still harsh, marginally smoother than sample 10 containing only 1% water, difference small. |
| 12 | 2.5% (w/w) nicotine with carbon dioxide and 1% water (w/w) | Very strong flavor, strong hit in mouth and throat |
| 13 | 2.5% (w/w) nicotine with carbon dioxide and 2% water (w/w) | Best of the 2.5% nicotine samples, still very strong hit in mouth and throat but smoother than sample 12 containing 1% water. Significantly smoother with better throat hit than sample 11. Compared to the 1% nicotine control (sample 5), the higher nicotine content is quickly apparent. But this sample is barely harsher than sample 5, is equally smooth and has a better throat hit. Compared to the best of the 1% nicotine samples (sample 7), both 13 and 7 are reasonably smooth and "vapable", but it quickly becomes apparent that sample 13 is much stronger in terms of nicotine. Much bigger hit. |

TABLE 2-continued

| Sample | Sample description | Summary of vaping experience |
|---|---|---|
| 14 | 2.5% (w/w) nicotine with carbon dioxide | Still very strong, but smoother than 2.5% nicotine (sample 9). Strong throat hit from small quantities of vapour. Sample 14 is not as smooth as samples 12 and 13 which have water added to 2.5% nicotine and carbon dioxide. Compared to samples 10 and 11 (nicotine plus water), sample 14 tasted notably better than 10 and a little better than 11. Sample 14 is smoother whereas samples 10 and 11 retain more harshness in the mouth. |

Example 3: Solubility of Carbon Dioxide in Nicotine Solutions

Into weighed plastic 500 ml bottles containing approximately 50 g of a solution of nicotine in glycerol/propylene glycol according to Table 3 were added 4-5 g solid carbon dioxide (dry-ice), sufficient to raise the pressure to 4-5 bar. The mixtures were held under pressure for 3 days before the pressure was released, and the mixtures were then stood at ambient temperature for 48 hours and then the new weight of the solution measured. The change in weight before and after addition of the CO2 enable the amount of CO2 incorporated into the solution to be derived, as well as the molar ratio of CO2 to nicotine. The results are shown in Table 3.

In a comparative experiment, a bottle containing 20 g pure nicotine was charged similarly with carbon dioxide; this did not result in any weight increase at all, suggesting no CO2 was incorporated into solution.

ing experiment are therefore thought to be higher than those actually achieved in KR 10-1208473.

A liquid composition was manufactured using 65 vol % propylene glycol, 23 vol % vegetable glycerine, 2 vol % ethyl alcohol, 7 vol % water and menthol. The menthol (a solid material) was added at 3 g to 97 ml of the propylene glycol/vegetable glycerine/ethyl alcohol/water mix to make up 100 ml total volume, such that the menthol is present at 3 g per 100 ml. The liquid composition was saturated with carbon dioxide at room temperature and atmospheric pressure by adding in a 500 ml bottle 100 ml of the liquid composition and 2 g of dry ice. The bottle was then sealed and then shaken for several minutes to dissolve the carbon dioxide in the liquid composition. After approximately 1 hour, the bottle was depressurised. The bottle was then unsealed and shaken again for approximately 1 minute. It was left at room temperature and atmospheric pressure for approximately 30 minutes to saturate the liquid composition with carbon dioxide.

By measuring the weight of the composition before and after saturation of CO2 the following results were obtained.

Sample 1: 106.772 g of mixture had 1.5 mg/g (40 mg/25 ml) of CO2.

Sample 2: 106.465 g of mixture had 1.62 mg/g (43 mg/25 ml) of CO2.

Following this, 80 mg of nicotine was added. After 48 hours, the amounts of CO2 were:

Sample 1: 0.9 mg/g i.e. 0.96 mg/ml of CO2 Sample 2: 1.06 mg/g i.e. 1.13 mg/ml of CO2

Accordingly, the methodology of KR 10-1208473 results in significantly lower amounts of CO2 incorporated compared with the methodology used in example 3.

TABLE 3

| Solvent | Nicotine g/kg | Nicotine wt % | Solution before CO2 g | Solution after CO2 g | Added CO2 g | Solubility CO2 g/kg | Estimated density kg/L | Solubility CO2 g/L | Molar ratio CO2/ nicotine mol/mol | Notes |
|---|---|---|---|---|---|---|---|---|---|---|
| 70:30 glycerol:propylene glycol | 0 | 0.0% | 50.00 | 50.19 | 0.19 | 3.8 | 1.19 | 4.5 | n/a | |
| 70:30 glycerol:propylene glycol | 4 | 0.4% | 49.96 | 50.44 | 0.48 | 9.5 | 1.19 | 11.3 | 8.77 | [1] |
| 70:30 glycerol:propylene glycol | 15 | 1.5% | 49.99 | 50.73 | 0.74 | 14.6 | 1.19 | 17.4 | 3.58 | [1] |
| 70:30 glycerol:propylene glycol | 45 | 4.5% | 50.00 | 51.03 | 1.03 | 20.2 | 1.19 | 24.0 | 1.65 | [1] |
| 70:30 glycerol:propylene glycol | 200 | 20.0% | 50.45 | 52.05 | 1.60 | 30.7 | 1.16 | 35.7 | 0.57 | |
| Propylene glycol | 200 | 20.0% | 49.97 | 51.23 | 1.26 | 24.6 | 1.03 | 25.3 | 0.45 | |
| Glycerol | 200 | 20.0% | 50.03 | 51.80 | 1.77 | 34.2 | 1.21 | 41.3 | 0.63 | |
| 70:30 glycerol:propylene glycol | 400 | 40.0% | 49.96 | 51.22 | 1.26 | 24.6 | 1.12 | 27.6 | 0.23 | |

Notes
[1] average of two results

Example 4: Comparative Examples

An experiment was conducted in line with the procedure of forming inhalable compositions enabled in KR 10-1208473. The following experiment was carried out on double scale compared to that indicated in KR 10-1208473 to facilitate more accurate weighing. The room temperature adopted in the following experiment was approx 16° C., which is thought to be lower than the laboratory temperature in KR 10-1208473. The CO2 levels achieved in the follow-

Example 5: Solubility of Carbon Dioxide in Nicotine Solutions with Low Propylene Glycol Using the same methodology as that of Example 3, solutions of nicotine in glycerol, nicotine, water, and propylene glycol (if present) were made as detailed in the Table 4. In Table 4, propylene glycol is referred to as "PG". The propylene glycol, when present, originated from the addition of a tobacco flavouring composition. The tobacco flavouring composition, referred to in Table 4 as "TF", (made up of tobacco flavouring dissolved/dispersed in propylene glycol) included propylene glycol at 65% by weight. Therefore the addition of 8% of the flavouring composition resulted in the addition of 5.2 wt % of propylene glycol to the inhalable composition overall, as detailed in the table below. For each experiment, the solution used was within 0.2 g of 50.0 g. As with Example 3, the solutions were weighed before and after the addition of the CO2, and the change in weight before and after addition of the CO2 enabled the amount of CO2 incorporated into the solution to be derived. The amount of carbon dioxide reported as being incorporated into solution is the average result achieved across two experiments.

TABLE 4

| Glycerol wt % | Nicotine wt % | Water wt % | TF wt % | PG wt % | Added CO2 (g) | Solubility of CO2 (g/kg) | Estd density (kg/l) | Solubility of CO2 (g/L) |
|---|---|---|---|---|---|---|---|---|
| 93.1 | 2 | 4.9 | 0 | 0 | 0.51 | 10 | 1.25 | 13 |
| 90.25 | 5 | 4.75 | 0 | 0 | 0.91 | 18 | 1.24 | 23 |
| 88.2 | 2 | 9.8 | 0 | 0 | 0.56 | 11 | 1.23 | 14 |
| 85.5 | 5 | 9.5 | 0 | 0 | 0.82 | 16 | 1.22 | 20 |
| 85.5 | 2 | 4.5 | 8 | 5.2 | 0.54 | 11 | 1.23 | 13 |
| 82.65 | 5 | 4.35 | 8 | 5.2 | 0.79 | 16 | 1.22 | 19 |
| 81 | 2 | 9 | 8 | 5.2 | 0.58 | 12 | 1.21 | 14 |
| 78.3 | 5 | 8.7 | 8 | 5.2 | 0.66 | 13 | 1.21 | 16 |

The invention claimed is:

1. An inhalable composition, suitable for use in an electronic cigarette device, comprising at least 1 g of nicotine per liter of composition and at least 1 g of carbon dioxide per liter of composition, wherein the nicotine and the carbon dioxide are dissolved or dispersed in a solvent, wherein the molar ratio of carbon dioxide to nicotine is at least 0.025:1, wherein the solvent comprises at most 5% by volume water in relation to the total volume of solvent, and wherein the solvent comprises glycerol.

2. The composition of claim 1, comprising 1-60 g/L of nicotine.

3. The composition of claim 1, comprising at least 3 g/L of nicotine.

4. The composition of claim 1, wherein the solvent further comprises propylene glycol, and the proportion of glycerol to propylene glycol present in the solvent is in the range of 95:5 to 5:95 by volume.

5. The composition of claim 1, wherein the solvent further comprises propylene glycol, and the proportion of glycerol to propylene glycol present in the solvent is in the range of 80:20 to 20:80 by volume.

6. The composition of claim 1, wherein the solvent further comprises propylene glycol, and the proportion of glycerol to propylene glycol present in the solvent is in the range of 70:30 to 30:70 by volume.

7. The composition of claim 1 further comprising one or more flavouring compounds.

8. A cartridge suitable for use with an electronic cigarette device, said cartridge containing the inhalable composition according to claim 1.

9. An electronic cigarette device comprising the cartridge of claim 8.

* * * * *